United States Patent [19]

Takahashi

[11] 4,239,066

[45] Dec. 16, 1980

[54] YARN FEEDER

[75] Inventor: Kihei Takahashi, Uozu, Japan

[73] Assignee: Yoshida Kogyo K.K., Tokyo, Japan

[21] Appl. No.: 58,254

[22] Filed: Jul. 17, 1979

[51] Int. Cl.[3] ..... D03D 47/36

[52] U.S. Cl. ..... 139/452; 242/47.01; 242/110.1; 66/132 R

[58] Field of Search ..... 242/47.01, 47.08, 47.09, 242/110, 110.1; 139/450, 452; 66/132 R

[56] References Cited

U.S. PATENT DOCUMENTS

| | | | |
|---|---|---|---|
| 3,126,607 | 3/1964 | Jenny | 242/110.1 |
| 3,243,975 | 4/1966 | Lawson et al. | 66/132 |
| 3,270,976 | 9/1966 | Smith | 242/110.1 |

FOREIGN PATENT DOCUMENTS

| | | | |
|---|---|---|---|
| 983389 | 2/1965 | United Kingdom | 242/110.1 |

*Primary Examiner*—Henry Jaudon

*Attorney, Agent, or Firm*—Robert E. Burns; Emmanuel J. Lobato; Bruce L. Adams

[57] ABSTRACT

A weft yarn feeder for use in a shuttleless loom has a spool and a spindle extending rotatably through the shaft of the spool and supporting a pair of drive gears. A plurality of yarn rods jointly defining a generally cylindrical configuration around which a weft yarn is to be wound extend axially along the spool shaft. The end portions of the yarn rods are connected eccentrically to angularly spaced driven gears rotatably mounted on the flanges of the spool and with which the drive gears are held in driving mesh. The yarn rods and the driven gears are connected by pins extending loosely through radial slots in the spool flanges. The yarn rods are movable radially outwardly or inwardly in response to the turning of a knob fixed to the spindle.

8 Claims, 7 Drawing Figures

YARN FEEDER

BACKGROUND OF THE INVENTION

1. Field of the Invention

The present invention relates to a weft yarn feeder for use in shuttleless looms such as needle looms.

2. Prior Art

Known weft yarn feeders generally comprise a spool around which a weft yarn is wound and from which the weft yarn is fed or paid out at a constant rate to a filling carrier in response to the rotation of the spool in synchronism with operation of the filling carrier. There has been a need for a device incorporated in the weft yarn feeder for changing the rate of feed of the weft yarn so as to accommodate various yarn demands for different widths of fabric to be produced or so as to compensate for varying yarn stretchability due to different degrees of ambient temperature and humidity.

SUMMARY OF THE INVENTION

It is an object of the present invention to provide a yarn feeder having means for supplying a yarn at different rates of feed at a constant speed of rotation of the yarn feeder.

Another object of the present invention is to provide a yarn feeder having a gear mechanism for continuously and smoothly changing the diameter of yarn winding means.

According to the present invention, a yarn feeder includes a spindle extending axially through a spool and having a pair of drive gears at the ends of the spool. Each drive gear is held in driving mesh with a plurality of driven gears rotatably supported on one of the flanges of the spool. A plurality of yarn rods extend axially along and are disposed around the shaft of the spool. Each yarn rod has end portions connected to an axially aligned pair of the driven gears on the spool flanges through pins extending loosely through arcuate guide slots in the spool flanges. A knob is fixed to one end of the spindle. By turning the knob, the drive gears are angularly moved to cause the driven gears to be turned, whereupon the yarn rods are moved radially outwardly or inwardly to change the diameter of a cylindrical configuration defined jointly by the yarn rods and around which a weft yarn is to be wound.

BRIEF DESCRIPTION OF THE DRAWINGS

The above and other objects, features and advantages of the present invention will become apparent from the following description when taken in conjunction with the accompanying drawings, in which.

DESCRIPTION OF THE PREFERRED EMBODIMENT

Figure 1:
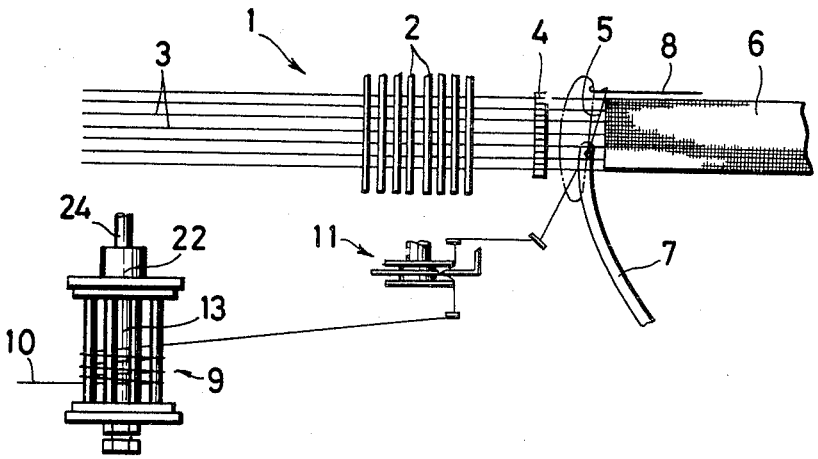
FIG. 1 is a schematic plan view of a needle loom in which a yarn feeder of the present invention is employed.

A weaving machine or loom 1 schematically illustrated in FIG. 1 generally comprises a plurality of heddles 2 for separating a plurality of warp threads 3 to form warp sheds successively, a beat-up reed 4 movable back and forth to beat up an inserted filling 5 against the fell of a narrow fabric 6 being produced, a filling carrier 7 pivotable to place a filling 5 across the warp shed, and a selvage-forming latch needle 8 reciprocable alongside of the fabric 6 for catching and knitting loops of fillings 5 with previous filling loops. The loom 1 also includes a weft yarn feeder 9 actuatable in synchronism with the operation of the filling carrier 7 for positively advancing a weft 10, and a tension compensator 11 disposed between the filling carrier 7 and the weft yarn feeder 9 for keeping the weft 10 under construction tension while the weft 10 is being supplied to the filling carrier 7.

Figure 2:
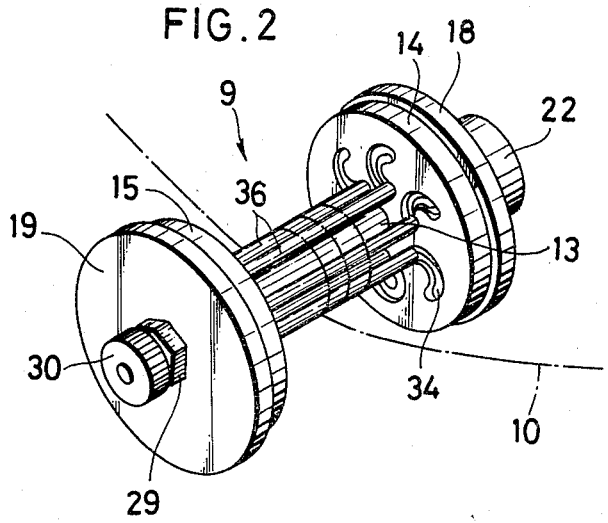
FIG. 2 is an enlarged perspective view of the yarn feeder.
Figure 3:
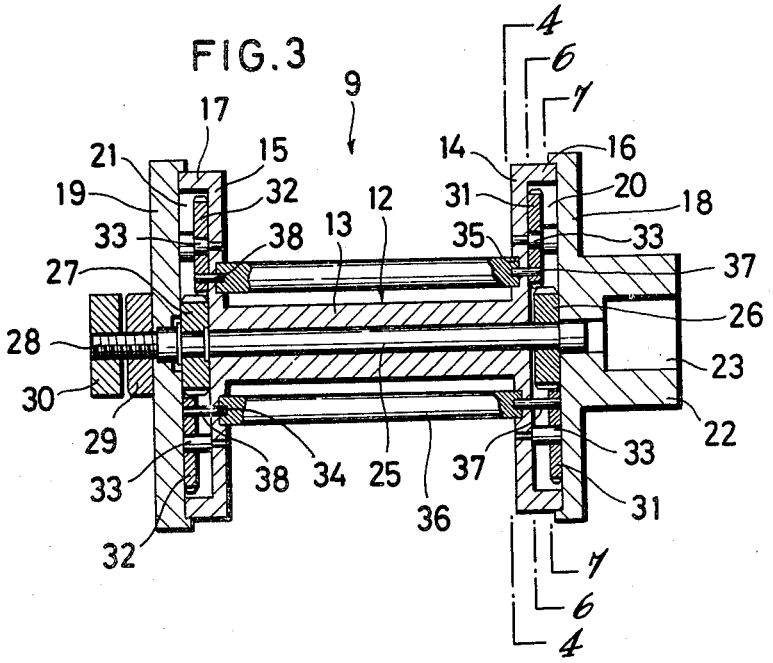
FIG. 3 is a longitudinal cross section view of the yarn feeder of FIG. 2.

As best shown in FIGS. 2 and 3, the weft yarn feeder 9 comprises a spool 12 including a hollow shaft 13 and a pair of circular flanges 14, 15 on the ends of the hollow shaft 13. The circular flanges 14, 15 have a pair of annular flanges or rims 16, 17, respectively, projecting axially away from each other. A pair of circular covers 18, 19 are mounted on the rims 16, 17, respectively. A pair of gear chambers 20, 21 are provided between the flange 14 and the cover 18 and between the flange 15 and the cover 19, respectively.

The cover 18 has an axial attachment projection 22 having an axial recess 23 for lockingly receiving a drive shaft 24 (FIG. 1) that is rotatable about its own axis at a constant rate of speed.

A spindle 25 extends axially through the hollow shaft 13 and is rotatably supported by the covers 18, 19. A pair of axially spaced drive gears 26, 27 are fixed to the spindle 25 and are located in the gear chambers 20, 21, respectively, at the ends of the spool 12. The spindle 25 has an externally threaded end portion 28 projecting beyond the cover 19. A fastening nut 29 is threaded over the threaded end portion 28. A peripherally knurled knob 30 is fixed to the threaded end portion 28. The spindle 25 can be turned about its own axis by turning the knob 30 by hand, and can be nonrotatably held in position relatively to the cover 19 by tightening the fastening nut 29 against the cover 19.

Figure 7:
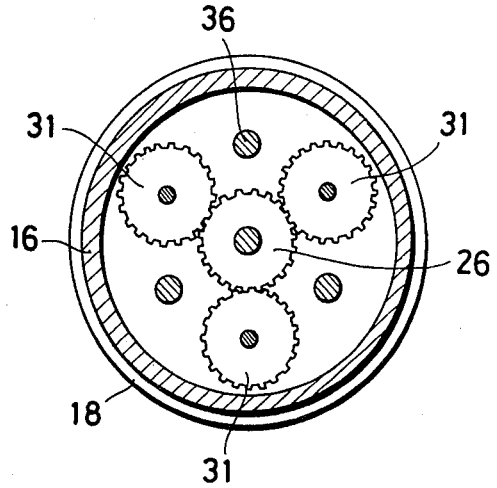
FIG. 7 is a cross section view taken along section line 7—7 of FIG. 3.

In each of the gear chambers 20, 21, a plurality of driven gears 31 or 32 (six in number in the illustrated embodiment) are rotatably supported on pins 33 mounted on the flange 14 or 15 and the cover 18 or 19. The pins 33 are angularly spaced from each other and are located around the drive gears 26, 27. The drive gears 26, 27 are held in driving mesh with the driven gears 31, 32, respectively. Each of the driven gears 31 in the gear chamber 20 is paired with and held in axial alignment with one of the driven gears 32 in the gear chamber 21. Adjacent ones of the driven gears 31 or 32 in the gear chambers 20 or 21 are axially displaced from each other so as to prevent any interference or contact therebetween, as shown in FIG. 7.

Figure 4:
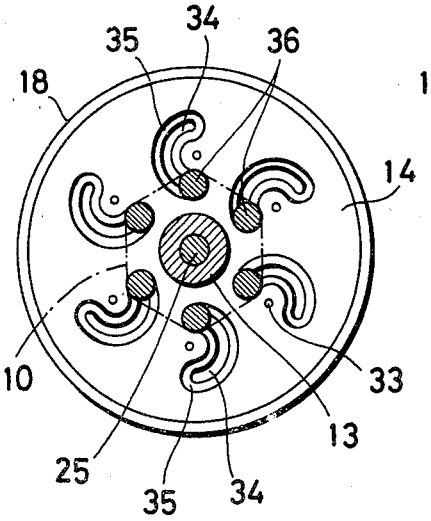
FIG. 4 is a cross section view taken along section line 4—4 of FIG. 3.
Figure 5:
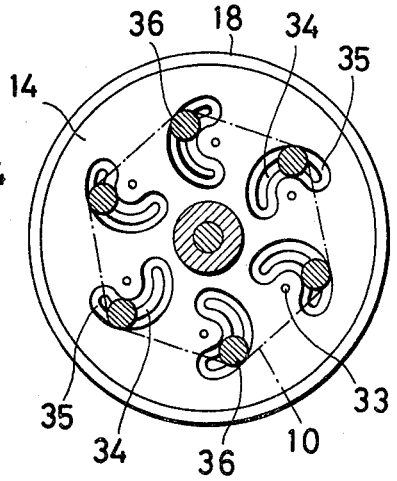
FIG. 5 is a view similar to FIG. 4, showing yarn rods displaced radially outwardly.
Figure 6:
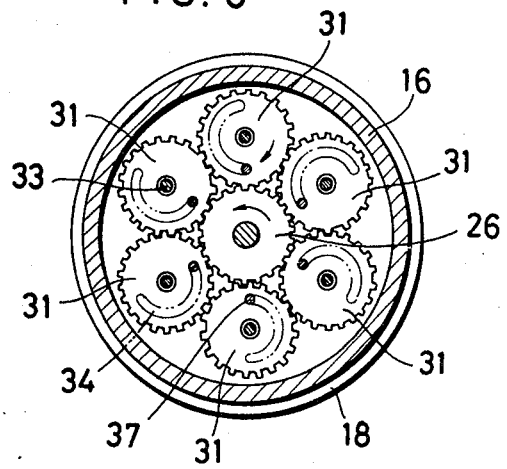
FIG. 6 is a cross section view taken along section line 6—6 of FIG. 3.

As best illustrated in FIGS. 4 and 5, each of the flanges 14, 15 has a plurality of arcuate guide slots 34 angularly spaced equal distances from each other and extending generally radially of the hollow shaft 13. Each of the arcuate guide slots 34 extends substantially halfway about one of the pins 33. Each guide slot 34 includes a recessed shoulder 35 extending therealong.

The arcuate guide slots 34 in the flange 14 are axially aligned with the arcuate guide slots 34 in the flange 15 and are paired therewith.

A plurality of yarn rods 36 of circular cross section extend axially along and are disposed radially around the hollow shaft 13. Each of the yarn rods 36 has a pair of end portions connected to a pair of the driven gears 31, 32 through a pair of pins 37, 38 connected eccentrically to the pair of the driven gears 31, 32, respectively, and extending loosely through a pair of the slots 34, 34 in the flanges 14, 15, respectively. The end portions of each yarn rod 36 are slidably received on a pair of the recessed shoulders 35, 35 in the flanges 14, 15.

The weft yarn 10 is wound around the yarn rods 36 jointly forming a cylinder-like configuration. The weft yarn 10 is positively fed along by rotation of the yarn feeder 9 about its own axis at a constant speed.

When it is necessary to change the rate of feed of the weft yarn 10, the knob 30 is rotated to turn the spindle 25. The drive gears 26, 27 are simultaneously rotated with the spindle 25 to cause the driven gears 31, 32 to be turned on the pins 33. The pins 37, 38 are then moved along the slots 34, whereupon the yarn rods 36 move radially outwardly or inwardly (FIGS. 4 and 5). Accordingly, the diameter of the cylinder-like configuration defined jointly by the yarn rods 36 and around which the weft yarn 10 is to be wound is changed to provide a different rate of feed of the weft yarn 10 while the weft yarn feeder 9 is being rotated at the same speed.

Since the yarn rods 36 are supported and driven at both ends, they move smoothly and uniformly in a radial direction in response to the rotation of the driven gears 31, 32. Such radial movement of the yarn rods 36 can be effected gradually with fine adjustment by the rotation of the knob 30.

Although a preferred embodiment has been shown and described in detail, it should be understood that various changes and modifications can be made therein without departing from the scope of the appended claims.

What is claimed is:

1. A yarn feeder comprising:

(a) a spool having a hollow shaft and a pair of circular flanges on the ends of said hollow shaft, each of said circular flanges having a plurality of radial guide slots angularly spaced from each other;

(b) a spindle extending through said hollow shaft and rotatable therein;

(c) a pair of spaced drive gears fixed to said shaft and disposed at the axial ends of said spool;

(d) a plurality of spaced pairs of driven gears rotatably mounted on said flanges, respectively, the driven gears in each pair being axially aligned with each other, said drive gears being held in driving mesh respectively with the pairs of the driven gears; and (e) a plurality of rods extending axially along and disposed radially around said shaft, each of said rods having a pair of end portions connected eccentrically to the respective driven gears in one pair through a corresponding pair of the guide slots in said flanges, whereby said rods can move radially outwardly from and inwardly to said shaft in response to rotation of said spindle.

2. A yarn feeder according to claim 1, each of said guide slots being arcuate in shape and extending about the axis of one of said driven gears.

3. A yarn feeder according to claim 1, the axes of the driven gears on each of said flanges being angularly spaced from each other and located around one of said drive gears.

4. A yarn feeder according to claim 1, adjacent ones of the driven gears on each of said flanges being axially displaced from each other so as to prevent any interference therebetween.

5. A yarn feeder according to claim 1, said rods being circular in cross section.

6. A yarn feeder according to claim 1, said flanges having a pair of rims projecting away from each other, including a pair of covers mounted on said rims, respectively, and covering said drive and driven gears on said flanges.

7. A yarn feeder according to claim 6, one of said covers having attachment means for connecting with a drive shaft.

8. A yarn feeder according to claim 7, including a knob attached to an end of said spindle which extends beyond the other of said covers.

* * * * *